US006282740B1

(12) United States Patent
Sobotka

(10) Patent No.: US 6,282,740 B1
(45) Date of Patent: Sep. 4, 2001

(54) COMBINATION TOOL FOR PICTURE FRAMING

(76) Inventor: Benny W. Sobotka, 1708 N. 23rd St., Lincoln, NE (US) 68503-1059

( * ) Notice: Subject to any disclaimer, the term of this patent is extended or adjusted under 35 U.S.C. 154(b) by 0 days.

(21) Appl. No.: 09/634,867

(22) Filed: Aug. 7, 2000

(51) Int. Cl.[7] ..... B25D 1/04
(52) U.S. Cl. ..... 7/143; 7/146
(58) Field of Search ..... 7/103, 105, 143, 7/146, 170

(56) References Cited

U.S. PATENT DOCUMENTS

| | | | | |
|---|---|---|---|---|
| D. 399,405 | | 10/1998 | Savoia . | |
| 1,598,420 | * | 8/1926 | Brossett | 7/143 |
| 1,748,673 | | 2/1930 | Hurst . | |
| 2,585,098 | | 2/1952 | Elliott . | |
| 4,200,943 | * | 5/1980 | Fredin et al. | 7/170 X |
| 4,414,698 | | 11/1983 | Epstein . | |
| 4,597,148 | | 7/1986 | Kennedy . | |
| 4,741,059 | | 5/1988 | Lee et al. . | |
| 5,127,122 | | 7/1992 | Sobotka . | |
| 5,845,354 | | 12/1998 | Long et al. . | |
| 5,870,786 | | 2/1999 | Papadopoulos . | |
| 5,893,185 | | 4/1999 | Okrepkie et al. . | |

FOREIGN PATENT DOCUMENTS

| | | | | |
|---|---|---|---|---|
| 1365642 | * | 5/1964 | (FR) | 7/143 |
| 2694482 | | 2/1994 | (FR) . | |
| 2227967 | | 8/1990 | (GB) . | |

* cited by examiner

*Primary Examiner*—James G. Smith
(74) *Attorney, Agent, or Firm*—Richard C. Litman

(57) ABSTRACT

A combination tool includes a series of devices suitable for use in the field of picture framing and light cabinetry work. The tool includes a generally rectangular body portion having a hand grip passage therethrough, with a hammer immovably affixed to and extending from the tool body. Opposite the hammer end of the tool body, a small gripping device extends from the tool, with the gripping device manipulated by a thumb lever pivotally affixed to that end of the tool. A beveled plate is secured to the tool body adjacent the gripping device, to enable the gripping jaws to be positioned very close to the working surface. One side of the tool includes a pair of opposed recesses therein, with one recess holding a an awl and the opposite recess holding a small pry bar. The pry bar includes a sharpened distal chisel blade end for use as a cutting blade, for removing backing from a picture frame, etc. Both the awl and the pry bar are pivotally secured within their respective recesses in the tool body. The present combination tool enables a craftsman to handle most tasks associated with picture framing, including driving small brads, nails, staples, etc. with the hammer; starting nail and screw holes with the awl; and disassembling and recycling picture frames by removing glazing points, etc. with the grippers, and prying loose staples, hangers, etc. using the pry bar.

18 Claims, 5 Drawing Sheets

COMBINATION TOOL FOR PICTURE FRAMING

BACKGROUND OF THE INVENTION

1. Field of the Invention

The present invention relates generally to hand tools, and more specifically to a combination device which is particularly useful in the field of picture framing. The present combination tool includes a hammer, pry bar and cutting or chisel blade, awl, and puller for removing staples, hanger brackets, etc., in a single device.

2. Description of the Related Art

The fields of picture framing and light cabinetry require many different operations, from the basic cutting of the wood and materials to the final finishing of the assembled frame or other device. Just the assembly of a picture frame requires several operations and a corresponding number of tools, for fastening the frame sections together, securing the glass or other protective cover within the frame, installing a protective backing sheet over the back of the picture or other article displayed within the frame, and installing one or more hangers on the frame. The tools generally required are a hammer, awl for starting screw and nail holes, and perhaps screwdrivers of various types where screws are used to assemble the frame and attach the hanger or hangers.

Quality picture frames are relatively costly and involve a fair amount of skilled hand work in their manufacture and assembly. The frame sections themselves are generally precisely cut in order to produce a precision fit, and are generally not components which are tossed casually aside when the article displayed in the frame is no longer desired. Accordingly, many picture frame components, particularly in the case of more costly hand made frames, are recycled by removing the backing, glass, various hangers, etc. This generally requires a small pry bar for removing staples, glazing points, and hangers, as well as a cutting blade for removing the old backing from the frame.

The present combination tool responds to these needs by providing nearly all of the required tools in a single, easily used device. The present combination tool includes a light tack hammer, awl for starting nail and screw holes, and a small pry bar with a sharpened chisel cutting edge for removing backing, staples, etc. The present tool also includes a pair of flexible jaws for gripping and removing various articles (staples, etc.) from the frame. Use of the present combination tool greatly reduces or obviates any requirement for additional tools for assembly or disassembly of a picture frame, and the present tool may also be applied to other light cabinetry work as well.

A discussion of the related art of which the present inventor is aware, and its differences and distinctions from the present invention, is provided below.

U.S. Pat. No. 1,748,673 issued on Feb. 25, 1930 to Thomas H. Hurst, titled "Combination Pliers And Tool," describes a tool comprising a pair of pliers with an additional spreader bar in the distal handle portion thereof. The spreader bar spreads the handle portions, and thus their attached jaw portions, slightly. Various sockets are provided for fitting over the ends of the jaws, with the spreading of the jaws by the handle spreader bar jamming the jaws against the inside of a socket to hold it in place on the jaws. This enables the Hurst device to be used as a screwdriver, hammer, etc., depending upon the configuration of the removable cap being used. The present combination tool invention does not have any removable components, with the hammer portion being permanently affixed to the remainder of the tool body. Moreover, Hurst does not provide an awl or pry bar, as provided by the present tool.

U.S. Pat. No. 2,585,098 issued on Feb. 12, 1952 to Howard R. Elliott, titled "General Utility Gripping Tool," describes a finger extension tool, wherein a pair of spring loaded fingers is extendible from a sleeve. The fingers are normally biased toward a retracted state, with compression of the extender at the handle end extending the fingers to grip or retrieve a part. Release of the compression results in the fingers automatically retracting to grip the part. The present invention includes a pair of small retractile gripping jaws, but they operate on a completely different lever principle, rather than using the linear actuation of the Elliott device. Moreover, the Elliott device does not include any of the other elements of the present combination tool.

U.S. Pat. No. 4,414,698 issued on Nov. 15, 1983 to Harry Epstein, titled "Automobile Fuse Puller And Combination Circuit Tester," describes an electrical continuity checker with a probe on one end and a fuse puller on the opposite end. The fuse puller comprises a pair of jaws which grip each side of a blade type fuse to withdraw it from its receptacle. However, the jaws are actuated by a principle more closely related to that of the gripping tool of the Elliott '098 U.S. Patent, discussed above, than to the principle of operation of the grippers of the present combination tool. Moreover, while the Epstein device comprises a combination tool, it does not include any mechanical tool configurations (e.g., hammer, awl, pry bar, etc., as provided in the present tool) other than the fuse puller jaws noted above.

U.S. Pat. No. 4,597,148 issued on Jul. 1, 1986 to Dori-Jayne Kennedy, titled "Tool For Removing Frame Clips," describes a device having an angled shank extending from a handle. The distal end of the shank has an asymmetrical blade extending therefrom, with the opposite lateral extensions of the blade having different configurations for engaging differently configured ends of spring clips which are installed between the rearward wall of a channel type picture frame, and the picture or backing held within the frame. Kennedy does not provide any other tool elements or functions for her frame clip tool, whereas the present combination tool includes gripper, pry bar, cutting blade, awl, and hammer elements in a single tool device.

U.S. Pat. No. 4,741,059 issued on May 3, 1988 to Yung-Hsiang Lee et al., titled "Reorganizable Tool For Various Purposes," describes a combination device having a series of removable components. A hammer head is stored between the handles of a pair of pliers, with the head attaching to the plier jaws by means of an intermediate component which holds the jaws together for the insertion of a screw longitudinally therebetween to hold the hammer head in place. The hammer head includes a knife blade and screwdriver blades therein, and one of the handles of the pliers contains a removable saw blade therein. However, Lee et al. do not provide an awl or pry bar with their combination tool, as provided by the present combination tool invention. Moreover, the Lee et al. tool must be disassembled for converting from one tool or function to another, whereas the present tool does not include any removable parts.

U.S. Pat. No. 5,127,122 issued on Jul. 7, 1992 to Benny W. Sobotka, titled "Combination Wedge Puller And Sawtooth Hanger-Bracket Removal Tool," describes an earlier tool invented by the present inventor. The earlier combination tool lacks several features of the present tool and is not so convenient to use as the present combination tool. In the earlier tool, the pry bar and distal blade fixedly extend from one side of the main body, and cannot be folded for user safety and to protect the blade. Also, no awl is provided, either fixed or folding, and no hammer is provided with the earlier developed combination tool. The present tool responds to each of these deficiencies in the earlier tool.

U.S. Pat. No. 5,845,354 issued on Dec. 8, 1998 to Joseph F. Long et al., titled "Multipurpose House And Shop Tool," describes a combination tool somewhat resembling a pipe wrench with rectilinearly movable lower jaw. The Long et al. tool has a handle or shank to which a fixed upper jaw and the movable lower jaw are attached. The fixed upper jaw has a blunt end for use as a hammer. The opposite end of the handle includes means for holding one of a series of removable screwdriver bits therein. However, the Long et al. tool does not include an awl or pry bar foldably extending therefrom, nor does it include any form of small gripping device, as provided in the present combination tool.

U.S. Pat. No. 5,870,786 issued on Feb. 16, 1999 to George N. Papadopoulos, titled "Utility Tool," describes a tool having various elements most useful to a painter or in similar work. The tool includes a scraping blade with various shapes and configurations at one end of a handle, with the opposite end of the handle having both standard and Phillips screwdriver blades foldably mounted therein Papadopoulos states that the end of the handle equipped with the screwdriver blades may be used as a hammer, but no leverage is provided, as the hammer head is a part of the handle shank where the tool is gripped. Also, no awl or pry bar is provided by Papadopoulos in his tool, nor is any gripping means provided, all of which are a part of the present combination tool.

U.S. Pat. No. 5,893,185 issued on Apr. 13, 1999 to Joseph Okrepkie et al., titled "Multipurpose Electricians Hand Tool," describes a combination wire cutter, stripper, and crimping tool comprising a pair of handles pivotally secured together. The head of one of the handles includes a set of removable screwdriver blades, while the other handle head includes a hammer head extending therefrom. The removability of various components, i.e., the screwdriver blades, and the lack of any form of extendible cutting blade and awl for starting holes, results in a tool which differs considerably from the present combination tool.

U.S. Pat. No. D-399,405 issued on Oct. 13, 1998 to Anthony G. Savoia, titled "Combination Tool," illustrates a generally rectangular object apparently having a corkscrew, knife blade, and bottle opener foldably extendible from the sides thereof. No portion of the Savoia design appears to provide any form of gripping means for pulling staples and the like, or hammer means, as provided by the present combination tool.

British Patent Publication No. 2,227,967 published on Aug. 15, 1990 to Acearch Limited, titled "Fastener Applying Device," describes a board with a set of rectilinear slides secured thereto, with a hammer block slidably secured to one of the slides A picture frame is placed on the board and a hanger positioned on the frame. The hammer block is positioned over the hanger and struck with a hammer to fasten the hanger to the frame. The hammer used is not a part of the Acearch tool and the Acearch tool is not a combination tool with additional functions, as is the present tool.

Finally, French Patent Publication No. 2,694,482 published on Feb. 11, 1994 to Gilles Deramecourt et al. describes (according to the English abstract) a device particularly suited as a utensil for pipe smokers, including a small penknife, nail file, hammer, spoon, and awl. The hammer appears to be more of a tamping device, rather than a device capable of driving small nails, brads, etc., as provided by the present combination tool. Moreover, the hammer or tamper is pivotally secured to the body of the device, and no means of gripping or prying of staples and the like from an object is provided by the device of the French Patent Publication, as provided by the present combination tool.

None of the above inventions and patents, taken either singly or in combination, is seen to describe the instant invention as claimed.

SUMMARY OF THE INVENTION

The present invention comprises a combination tool for picture framing, based upon the present inventor's earlier patented combination tool of U.S. Pat. No. 5,127,122. The present tool includes several additional features and modifications which result in a tool having even greater utility and versatility than the previously developed combination tool. The present tool includes various devices which are most useful for both assembling pictures in frames and hanging the picture and frame assembly, and also for removing pictures from frames for recycling the frames and components and hardware thereof.

The present combination tool essentially comprises a generally rectangular tool body having a hand grip passage therethrough. The body includes a hammer immovably affixed thereto and extending therefrom, with the grip of the body providing a hand grip for using the hammer. In the previous tool developed by the present inventor, a pry bar with sharpened cutting edge was affixed to and extended from the tool body portion, in approximately the location of the hammer extension from the present tool body. In order to eliminate any potential hazard of a continuously exposed and protruding sharpened blade, the present invention provides for the folding of the pry bar and blade and also provides for the foldable deployment of an awl adjacent the pry bar. The present tool also includes a small gripping device, for removing staples, glazing points, etc. from picture frames.

Accordingly, it is a principal object of the invention to provide an improved combination tool for picture framing work.

It is another object of the invention to provide an improved combination tool including a tool body having a hammer permanently and immovably affixed thereto and extending therefrom.

It is a further object of the invention to provide an improved combination tool including a pry bar with sharpened chisel blade at its distal end and an awl, both of which are foldably affixed to the tool body.

An additional object of the invention is to provide an improved combination tool including small gripping means adjustably extending from one end of the tool body.

Still another object of the invention is to provide an improved combination tool which various components are permanently affixed to the tool body, for precluding loss of any of the components of the tool.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
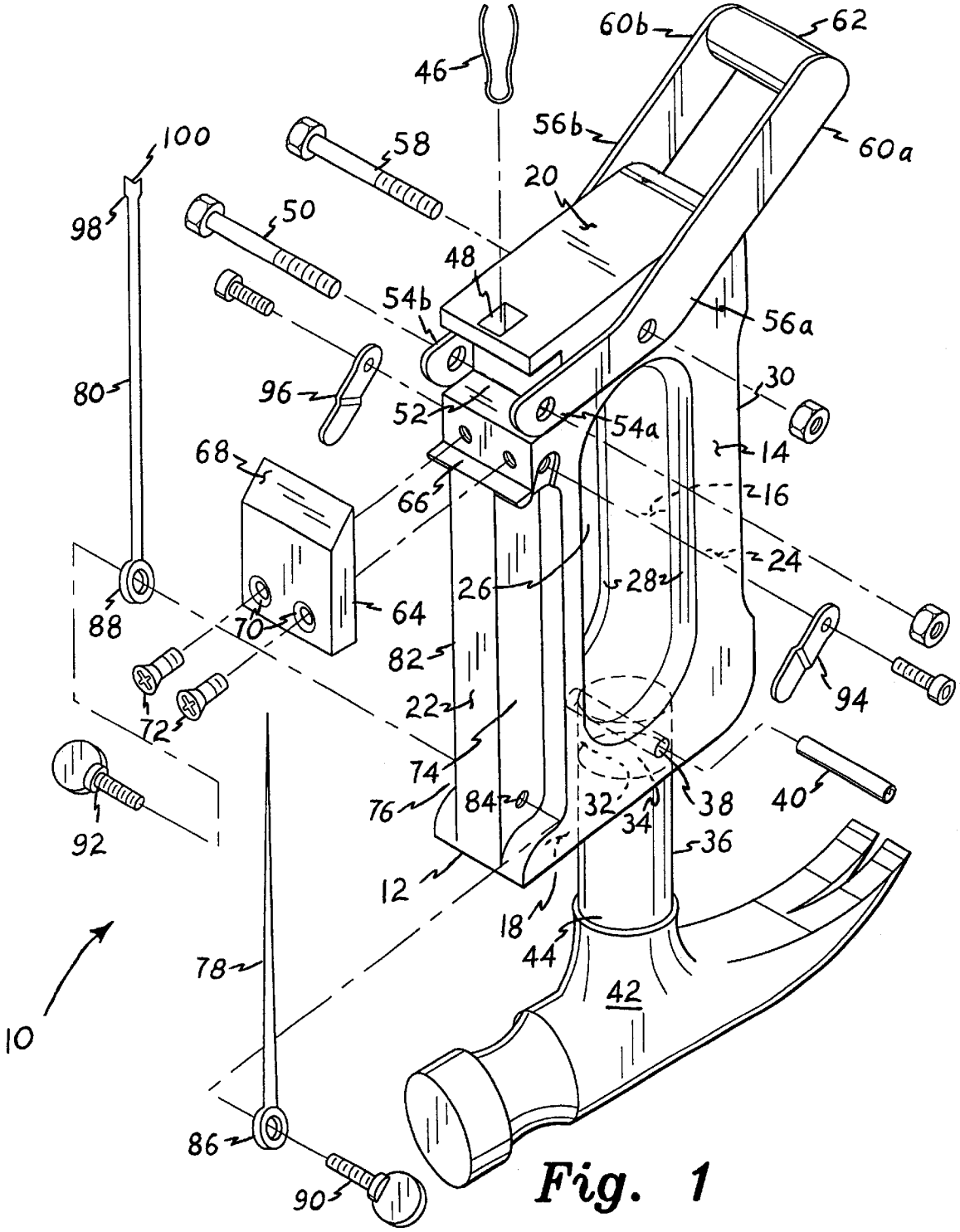
FIG. 1 is an exploded right side perspective view of the present combination tool, showing its various components and features.

The present invention comprises a combination tool for use in light woodwork and cabinetry, but which is adapted particularly well for use in assembling pictures in framing and in removing pictures from such framing for recycling of the frames. FIG. 1 of the drawings provides an exploded perspective view of the present tool 10, showing all of its various components. The tool 10 includes a generally rectangular tool body 12 serving as the central structure of the device. The tool body 12 may be formed of any practicable material, such as wood, plastic, lighter and softer metals such as aluminum, etc. The body 12 may be formed of heavier and harder materials, such as stainless or other steels, if desired, but this will result in a relatively heavy tool body which may not be desirable in most circumstances.

The tool body 12 includes opposite parallel first and second faces, respectively 14 and 16 (the second face 16 is concealed in the drawing Figures), opposite first and second ends, respectively 18 and 20, and opposite first and second sides, respectively 22 and 24. A hand grip passage 26 with smoothly rounded edges 28 is formed through the tool body, serving as a handle for a person using the present tool 10. The edges 30 of the second side 24 are also smoothly rounded, in order to provide a comfortable and more ergonomic grip for the hand of a person using the present combination tool 10.

Figure 2:
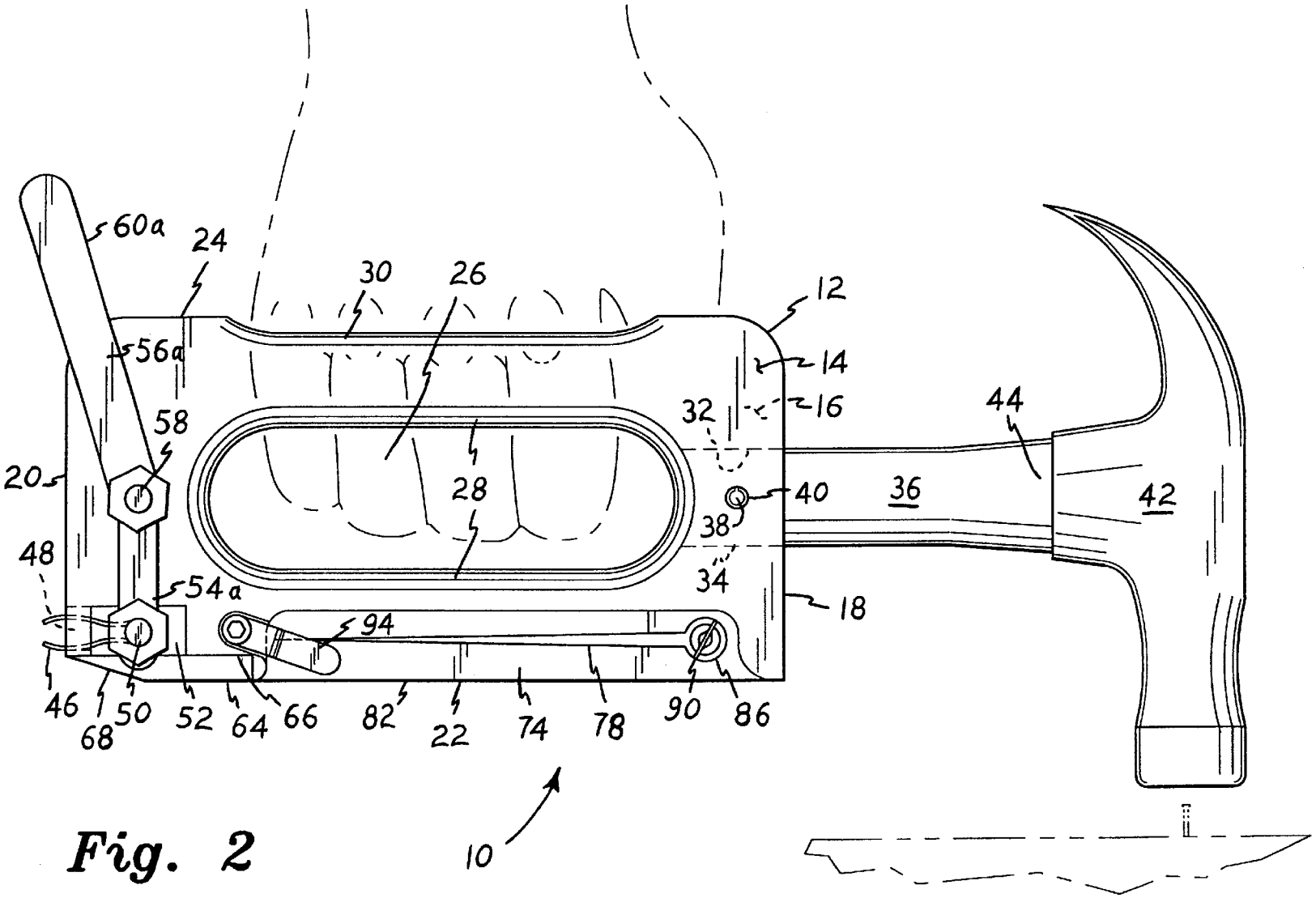
FIG. 2 is a right side elevation view of the present tool, showing its use as a hammer.

The first end 18 of the tool body 12 has a socket 32 formed therein, extending inwardly toward the hand grip passage 26. This socket 32 secures the attachment end 34 of a hammer shank or shaft 36 to the tool body 12, allowing the combination tool 10 to be used as a hammer, as shown in FIG. 2 of the drawings. The tool body 12 and attachment end 34 of the shank 36 each have a concentric passage 38 formed therethrough and extending completely through the tool body 12 from the first face 14 to the opposite second face 16, through which a locking pin 40 (roll pin, etc.) is installed to permanently and immovably affix the shank 36 to the tool body 12. The hammer shank 36 thus extends from the first end 18 of the tool body 12, with a hammer head 42 (claw hammer, as shown, or other hammer head type as desired) permanently and immovably affixed to the distal end 44 of the hammer shank, opposite the tool body 12.

Figure 3:
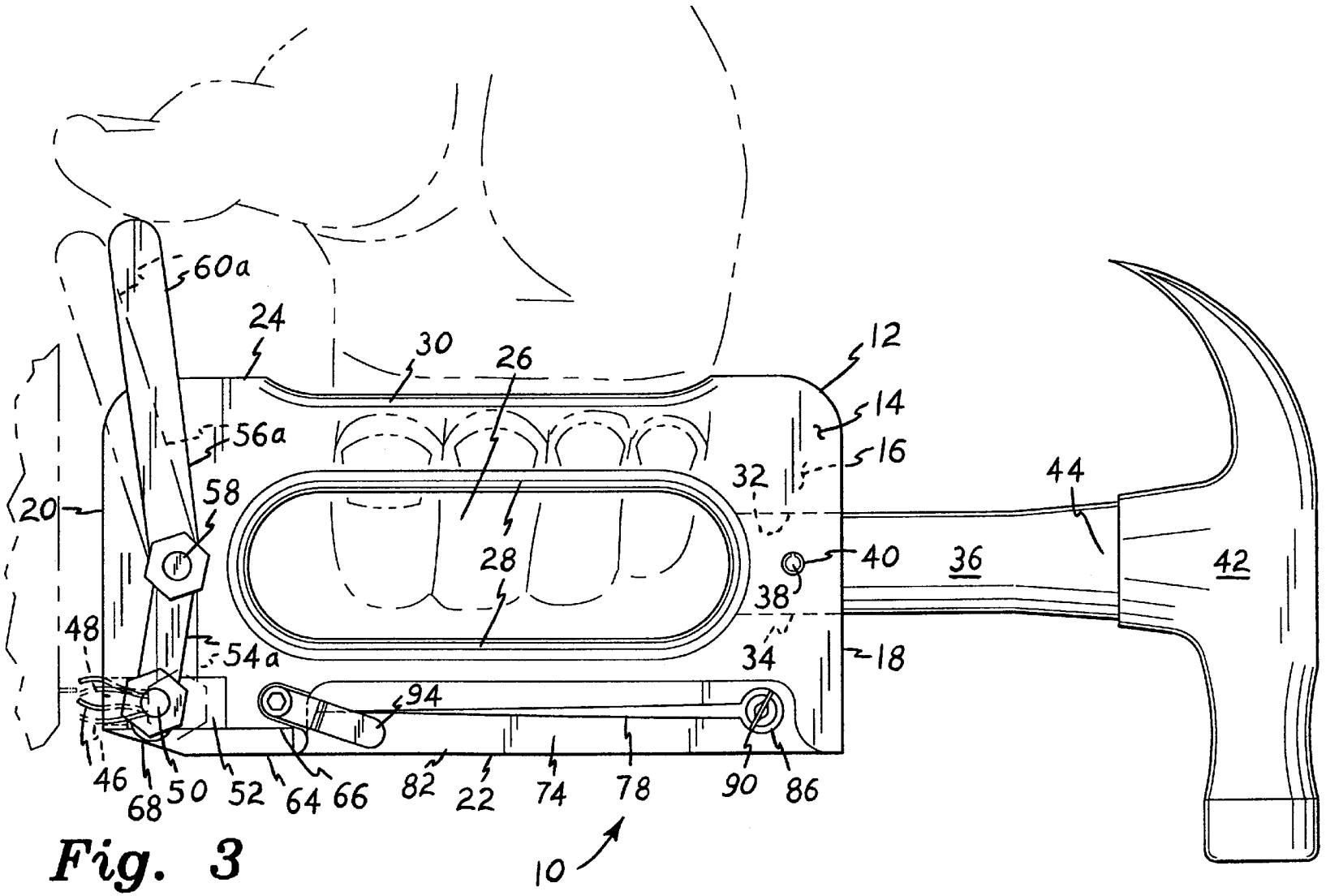
FIG. 3 is a right side elevation view of the present tool, showing the operation of the gripping device at the end of the tool opposite the hammer extension.

The opposite second end 20 of the tool 10 has a gripping or pulling device extending therefrom, comprising a small, generally U-shaped spring steel clip 46 residing in a slot 48 formed through the second end 20 of the tool body 12. The closed end of the clip 46 has a bolt 50 passing therethrough, with the bolt 50 being free to move laterally, i.e., generally parallel to the first side 22 of the tool body 12, in a clearance channel 52 formed in the first side 22 of the tool body 12, adjacent the second end 20 thereof. The gripper clip slot 48 communicates with the clearance channel 52, so that when the bolt 50 is moved laterally away from the slot 48, the clip 46 is drawn downwardly into the slot 48, closing the clip 46 ends together to grip an object as shown in FIG. 3.

The clip actuating bolt 50 passes through the distal ends 54*a* and 54*b* of a pair of arms 56*a* and 56*b*, respectively adjacent each face 14 and 16 of the tool body 12, which pivot about a generally centrally disposed pivot bolt 58. (Both arms are shown in FIG. 1, with only the first arm 54*a* being visible in the other Figures.) The arm actuating ends 60*a* and 60*b* are connected by a thumb actuated lever 62 (illustrated in the perspective view of FIG. 1), which when pushed generally away from the tool body 12, causes the opposite distal ends 54*a* and 54*b* of the arms 56*a* and 56*b* to draw the clip attachment bolt 50 away from the clip slot 48, thus drawing the clip 46 downwardly into the slot 48 and urging the two jaws of the clip 46 toward one another to grip an article (glazing point, staple, etc.) therein, as shown in FIG. 3 of the drawings.

A bevel plate 64 is secured to a recess 66 formed in the first side 22 of the tool body 12, adjacent the second end 20 thereof. The bevel plate 64 has an angled or beveled face portion 68 immediately adjacent the second end 20 of the tool body 12, with the bevel plate 64 serving as a fulcrum when the gripping clip 46 is used. The plate 64 also closes the clip bolt clearance channel 52 end. The bevel plate 64 is preferably formed of a relatively hard material (stainless or tool steel, etc.) and may be provided as a separate component when the tool body 12 is formed of a softer material. As the first side 22 of the tool body 12 often bears against the surface of an article being worked, the bevel plate 64 is preferably secured to the tool body 12 using countersunk holes 70 and flush screws 72 (FIG. 1) to present a smooth side 22.

A first and a second recess, respectively 74 and 76, are formed respectively in the first and second faces 14 and 16 of the tool body 12, adjacent the first side thereof. (The second or pry bar recess 76 is visible only in the perspective view of FIG. 1.) These two recesses provide folding or pivoting storage respectively for an awl 78 and a small pry bar 80 (visible in FIGS. 1 and 5) pivotally secured within the respective recesses 74 and 76. The two recesses 74 and 76 define a pivot tool attachment portion 82 therebetween, with the pivot tool attachment portion 82 having a threaded hole 84 formed therethrough near the first end 18 of the tool body, and extending between the two recesses 74 and 76.

The awl 78 and pry bar 80 each have a pivot attachment end, respectively 86 and 88, comprising an eye through which a threaded fastener, respectively 90 and 92, passes to engage the hole 84 from each side thereof. The fasteners 90, 92 are preferably thumbscrews having relatively wide flanges manipulable with fingers and thumb, to preclude any need for additional tools for using the implements of the present combination tool 10. The awl 78 and pry bar 80 are deployed by loosening the appropriate thumbscrew 90 or 92, and pivoting the tool 78 or 80 outwardly from its respective recess 74 or 76. Retaining clips, respectively 94 and 96, serve to hold the distal ends of the two tools 78 and 80 selectively in their stowed positions as desired. The tools 78 and 80 may be locked in their extended or stowed positions by tightening the appropriate thumbscrew 90 or 92, thereby causing the lower edge of the flange of the screw to bear against the eye 86 or 88 of the tool 78 or 80.

Figure 4:
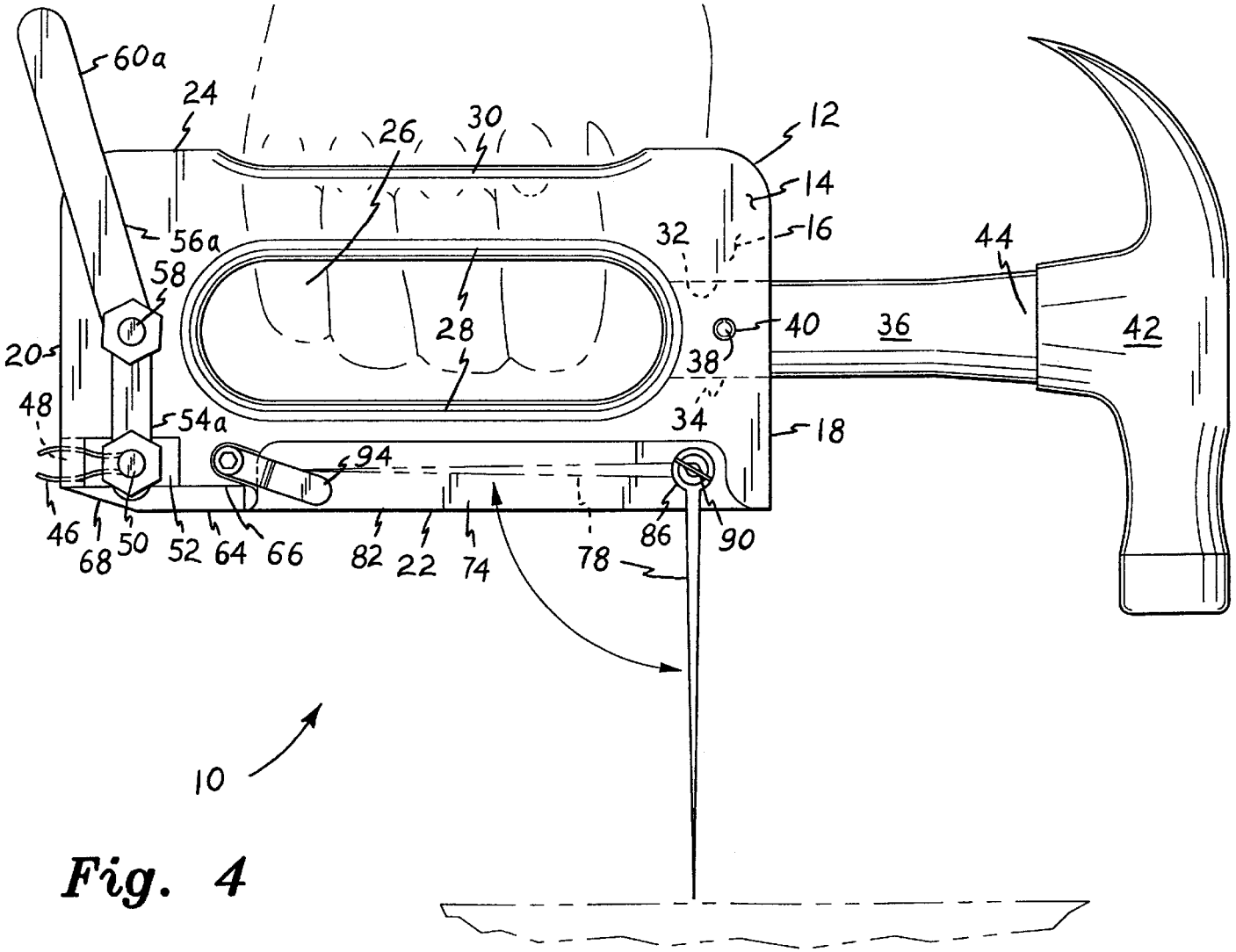
FIG. 4 is a right side elevation view of the present tool, showing the use of the awl foldably extended from the tool body.

The awl 78 is preferably a "scratch awl," i.e., a relatively small and sharply pointed tool used for scribing lines, and more particularly starting holes for screws and nails in the primary environment of the present invention, as shown in FIG. 4 of the drawings. Eye screws are used frequently in picture frames, for the attachment of a hanger wire thereto for hanging the assembly. The awl 78 may also be used to drive such eye screws after starting the eye screw in the hole provided by the awl, by inserting the awl 78 through the eye of the screw and rotating the awl to provide the leverage in driving the eye screw into the back of the frame.

Figure 5:
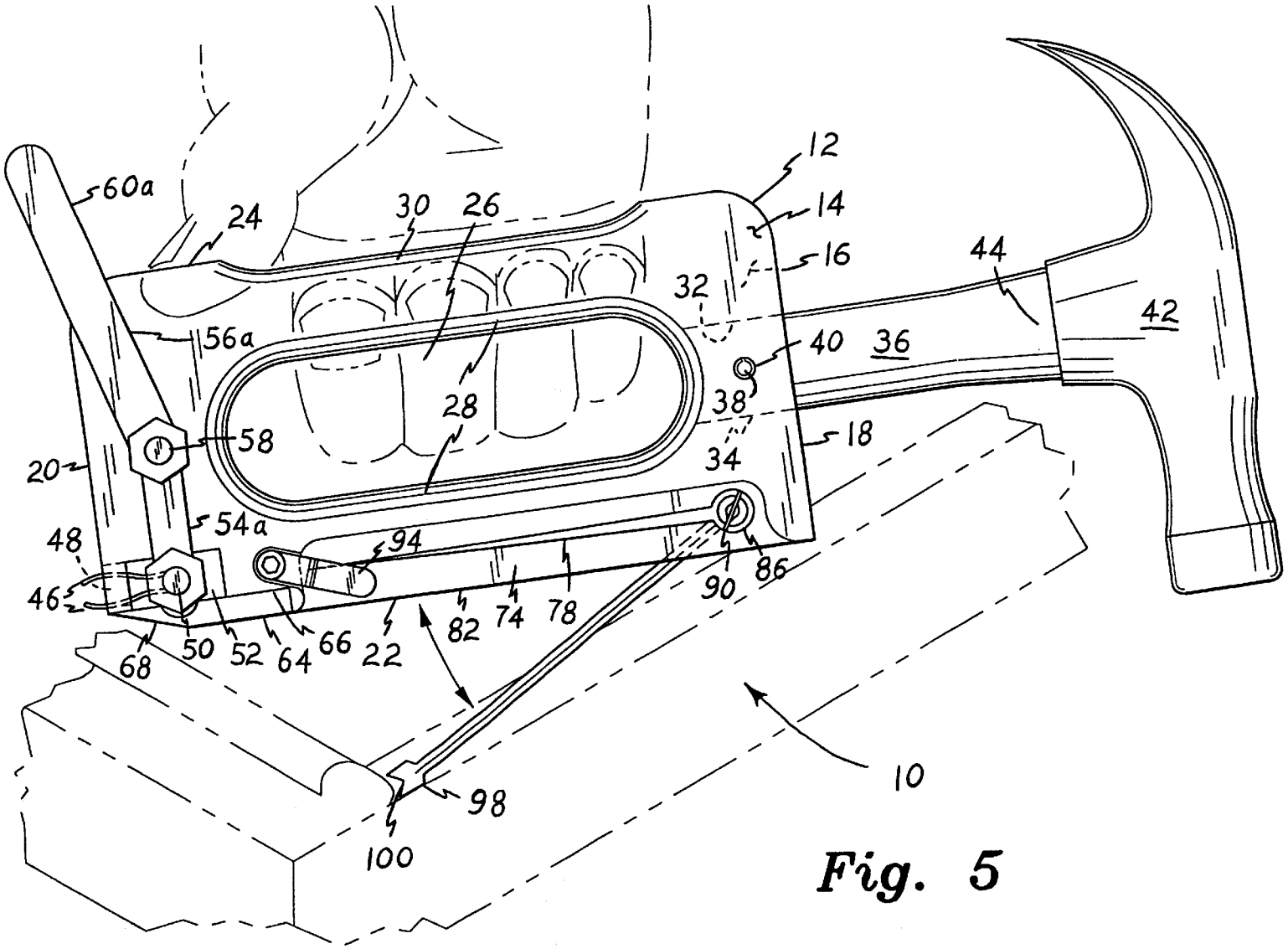
FIG. 5 is a right side elevation view of the present tool, showing the use of the foldably extended pry bar and chisel blade.

The small pry bar 80 may be used for levering out staples and hangers from the backs of picture frames, but the distal end 98 thereof is flattened and beveled to a sharp chisel shaped cutting edge 100, which serves well for cutting the paper backing from a picture frame assembly, as shown in FIG. 5 of the drawings. The cutting edge 100 is preferably formed to have a V-shaped indentation, which tends to center the two straight sides of the blade to each side of a sheet of paper or other material being cut, to hold the blade 100 in place on the sheet as the blade is run along the sheet, somewhat as shown in FIG. 5 of the drawings.

In summary, the present combination tool provides a most useful accessory for those engaged in the assembly, disassembly, and recycling of picture frames and other small cabinetry articles. The combination of six different tools, comprising a hammer, nail pulling claws extending from the hammer, small plier-like gripping clip, awl, pry bar, and cutting blade, all combined conveniently in a single tool, results in practically all of the tools and implements required for such work, being readily at hand. Moreover, all of the various tools and implements of the present combination tool remain assembled or attached to the tool body, thus avoiding any chance that any of the implements will be lost, as may be the case with other devices having removable components. The present combination tool will prove to be a most desirable device for those who work in picture framing and related activities, with the economy and convenience of providing a number of tools in a single device providing great value and utility for picture framers and others in similar work.

It is to be understood that the present invention is not limited to the sole embodiment described above, but encompasses any and all embodiments within the scope of the following claims.

I claim:

1. A combination tool for picture framing, comprising:

a generally rectangular tool body having a hand grip passage formed therethrough;

said tool body having a first face, a second face opposite said first face, a first end, a second end opposite said first end, a first side, and a second side opposite said first side;

a hammer shank permanently and immovably affixed to and extending from said first end of said tool body;

a hammer head permanently and immovably affixed to said hammer shank opposite said tool body;

a first recess formed in said first face adjacent said first side of said tool body, and a second recess formed in said second face adjacent said first side of said tool body;

an awl having a pivot attachment end pivotally secured within said first recess adjacent said first end of said tool body, and pivotally extendible from said first recess;

a pry bar having a pivot attachment end pivotally secured within said second recess adjacent said first end of said tool body, and pivotally extendible from said second recess; and manipulable gripping means adjustably extending from said second end of said tool body, adjacent said first side thereof.

2. The combination tool according to claim 1, wherein:

said tool body further includes a pivot tool attachment portion between said first and said second recess;

said pivot tool attachment portion has a threaded passage formed therethrough adjacent said first end of said tool body, and extending between said first and said second recess;

the pivot attachment end of said awl and said pry bar each comprise an eye; and the combination tool further comprises a first and a second thumbscrew, said awl and said pry bar being each pivotally secured to said pivot tool attachment portion of said tool body respectively by the first and the second thumbscrew respectively passing through the eye of said awl and the eye of said pry bar and engaging said threaded passage of said tool attachment portion of said tool body.

3. The combination tool according to claim 2, further including awl and pry bar retaining means for selectively retaining said awl and said pry bar respectively within said first and said second recess for storage as desired.

4. The combination tool according to claim 2, wherein:

said pry bar further includes a distal end opposite said pivot attachment end; and said distal end of said pry bar has a beveled chisel blade tip.

5. The combination tool according to claim 1, further including:

a bevel plate secured to said first side of said tool body adjacent said second end thereof;

said bevel plate having a beveled face portion immediately adjacent said second end of said tool body; and said bevel plate being formed of a harder material than said tool body.

6. The combination tool according to claim 1, wherein:

said tool body further includes a socket extending from said first end toward said hand grip passage;

said hammer shank has an attachment end secured within said socket of said tool body; and said tool body further includes a lock pin extending through said tool body from said first face to said second face and through said attachment end of said hammer shank.

7. A combination tool for picture framing, comprising:

a generally rectangular tool body having a hand grip passage formed therethrough;

said tool body having a first face, a second face opposite said first face, a first end, a second end opposite said first end, a first side, and a second side opposite said first side;

a hammer shank permanently and immovably affixed to and extending from said first end of said tool body;

a hammer head permanently and immovably affixed to said hammer shank opposite said tool body;

a first recess formed in said first face adjacent said first side of said tool body, and a second recess formed in said second face adjacent said first side of said tool body;

an awl having a pivot attachment end pivotally secured within said first recess adjacent said first end of said tool body, and pivotally extendible from said first recess; and a pry bar having a pivot attachment end pivotally secured within said second recess adjacent said first end of said tool body, and pivotally extendible from said second recess.

8. The combination tool according to claim 7, wherein:

said tool body further includes a pivot tool attachment portion between said first and said second recess;

said pivot tool attachment portion has a threaded passage formed therethrough adjacent said first end of said tool body, and extending between said first and said second recess;

the pivot attachment end of said awl and said pry bar each define an eye; and the combination tool further comprises a first and a second thumbscrew, said awl and said pry bar being each pivotally secured to said pivot tool attachment portion of said tool body respectively by the first and the second thumbscrew respectively passing through the eye of said awl and the eye of said pry bar and engaging said threaded passage of said tool attachment portion of said tool body.

9. The combination tool according to claim 8, further including awl and pry bar retaining means for selectively retaining said awl and said pry bar respectively within said first and said second recess for storage as desired.

10. The combination tool according to claim 8, wherein:

said pry bar further includes a distal end opposite said pivot attachment end; and said distal end of said pry bar has a beveled chisel blade tip.

11. The combination tool according to claim 7, further including:

a bevel plate secured to said first side of said tool body adjacent said second end thereof;

said bevel plate having a beveled face portion immediately adjacent said second end of said tool body; and said bevel plate being formed of a harder material than said tool body.

12. The combination tool according to claim 7, wherein:

said tool body further includes a socket extending from said first end toward said hand grip passage;

said hammer shank has an attachment end secured within said socket of said tool body; and said tool body further includes a lock pin extending through said tool body from said first face to said second face and through said attachment end of said hammer shank.

13. A combination tool for picture framing, comprising:

a generally rectangular tool body having a hand grip passage formed therethrough;

said tool body having a first face, a second face opposite said first face, a first end, a second end opposite said first end, a first side, and a second side opposite said first side;

a hammer shank permanently and immovably affixed to and extending from said first end of said tool body;

a hammer head permanently and immovably affixed to said hammer shank opposite said tool body;

a first recess formed in said first face adjacent said first side of said tool body, and a second recess formed in said second face adjacent said first side of said tool body;

an awl and a pry bar extending from said tool body; and manipulable gripping means adjustably extending from said second end of said tool body, adjacent said first side thereof.

14. The combination tool according to claim 13, wherein:

said tool body further includes a pivot tool attachment portion between said first and said second recess;

said pivot tool attachment portion has a threaded passage formed therethrough adjacent said first end of said tool body, and extending between said first and said second recess;

the awl and said pry bar each have a pivot attachment eye; and the combination tool further comprises a first and a second thumbscrew, said awl and said pry bar being each pivotally secured to said pivot tool attachment portion of said tool body respectively by the first and the second thumbscrew respectively passing through the eye of said awl and the eye of said pry bar and engaging said threaded passage of said tool attachment portion of said tool body.

15. The combination tool according to claim 14, further including awl and pry bar retaining means for selectively retaining said awl and said pry bar respectively within said first and said second recess for storage as desired.

16. The combination tool according to claim 14, wherein:

said pry bar further includes a distal end opposite said pivot attachment end; and said distal end of said pry bar defines a beveled chisel blade tip.

17. The combination tool according to claim 13, further including:

a bevel plate secured to said first side of said tool body adjacent said second end thereof;

said bevel plate having a beveled face portion immediately adjacent said second end of said tool body; and said bevel plate being formed of a harder material than said tool body.

18. The combination tool according to claim 13, wherein:

said tool body further includes a socket extending from said first end toward said hand grip passage;

said hammer shank has an attachment end secured within said socket of said tool body; and said tool body further includes a lock pin extending through said tool body from said first face to said second face and through said attachment end of said hammer shank.

* * * * *